US007563406B2

(12) United States Patent
Rapp

(10) Patent No.: US 7,563,406 B2
(45) Date of Patent: Jul. 21, 2009

(54) DEVICE FOR SUPPLYING CASTING INSTALLATIONS WITH MOLTEN METAL

(75) Inventor: Josef Rapp, Traunkirchen (AT)

(73) Assignee: Meltec Industriofenbau GmbH, Kirchham (AT)

( * ) Notice: Subject to any disclaimer, the term of this patent is extended or adjusted under 35 U.S.C. 154(b) by 386 days.

(21) Appl. No.: 10/560,211

(22) PCT Filed: Apr. 30, 2004

(86) PCT No.: PCT/EP2004/004581

§ 371 (c)(1),
(2), (4) Date: Jun. 26, 2006

(87) PCT Pub. No.: WO2004/110681

PCT Pub. Date: Dec. 23, 2004

(65) Prior Publication Data

US 2007/0074844 A1 Apr. 5, 2007

(30) Foreign Application Priority Data

Jun. 13, 2003 (EP) ..... 03013322

(51) Int. Cl.
*B22D 17/30* (2006.01)

(52) U.S. Cl. ..... 266/239

(58) Field of Classification Search ..... 266/236, 266/239

See application file for complete search history.

(56) References Cited

U.S. PATENT DOCUMENTS

| | | | | |
|---|---|---|---|---|
| 6,345,964 | B1 | 2/2002 | Cooper | |
| 6,953,548 | B2 * | 10/2005 | Mancusi | 266/239 |
| 2007/0074844 | A1 * | 4/2007 | Rapp | 164/336 |

FOREIGN PATENT DOCUMENTS

| | | | |
|---|---|---|---|
| EP | 1486277 | B1 | 12/2006 |
| JP | 08033971 | A | 2/1996 |
| JP | 2002144013 | A | 5/2002 |

OTHER PUBLICATIONS

European Search Report dated Nov. 11, 2003.
European Examination Report dated Jul. 8, 2005.
International Search Report dated May 11, 2006.

* cited by examiner

*Primary Examiner*—Scott Kastler
(74) *Attorney, Agent, or Firm*—Ganz Law, P.C.

(57) ABSTRACT

The invention relates to a device for supplying casting installations with molten metal. Said device comprises a crucible into the melt of which a dosing pump dips and supplies a discharge tube (12) communicating therewith with melt. The discharge tube (12) and the pump tube (11) are interlinked via a U-shaped connecting tube (15) to give a one-piece crucible insert. The discharge neck (13) of the discharge tube (12) is mounted so as to be swivelable about the axis (30) of the discharge tube. The inventive design allows for a simple maintenance and production of the dosing device. Moreover, the crucible position no longer has to be adapted to the position of the casting installation.

15 Claims, 3 Drawing Sheets

Figure 1:
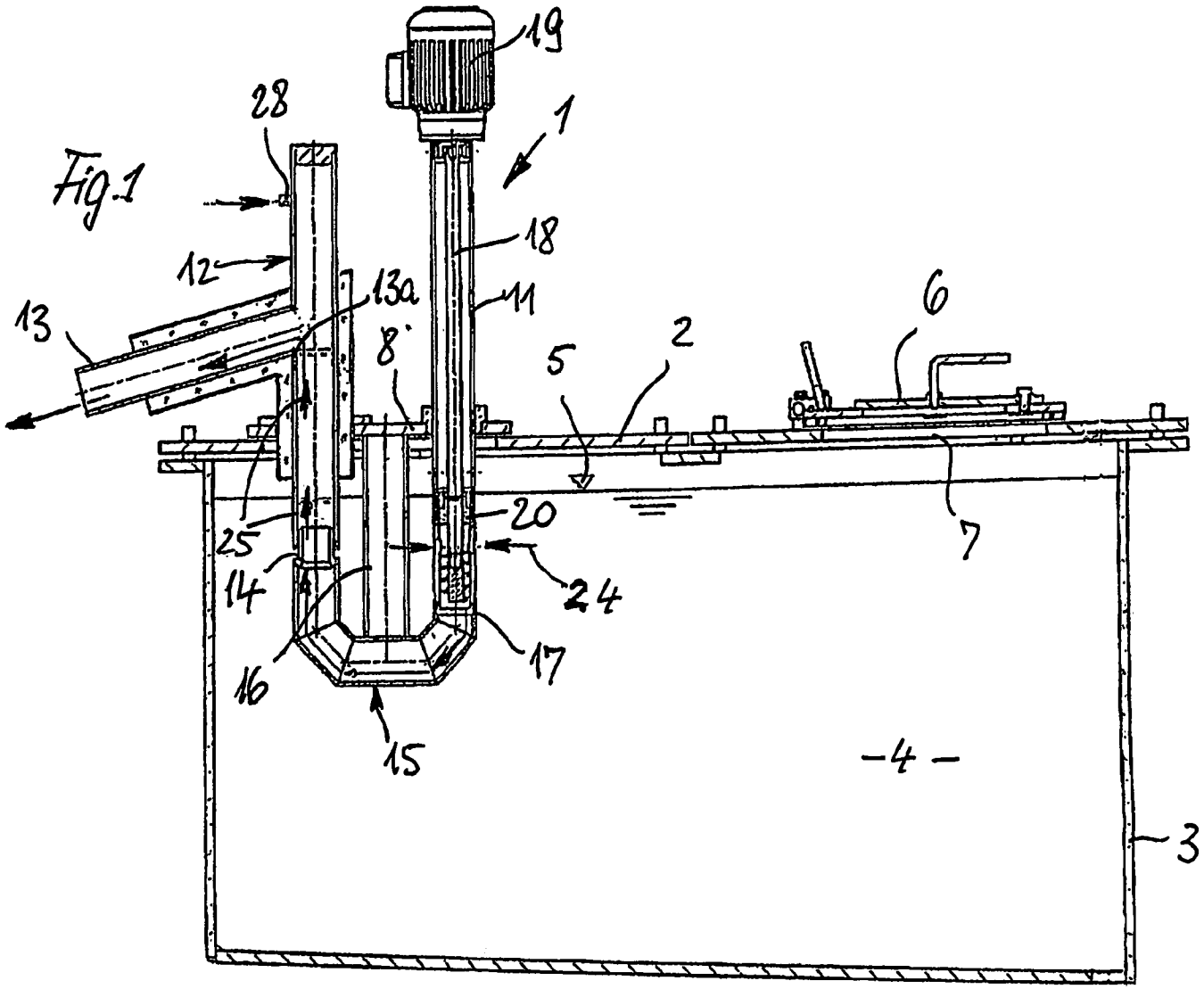

FIG.5
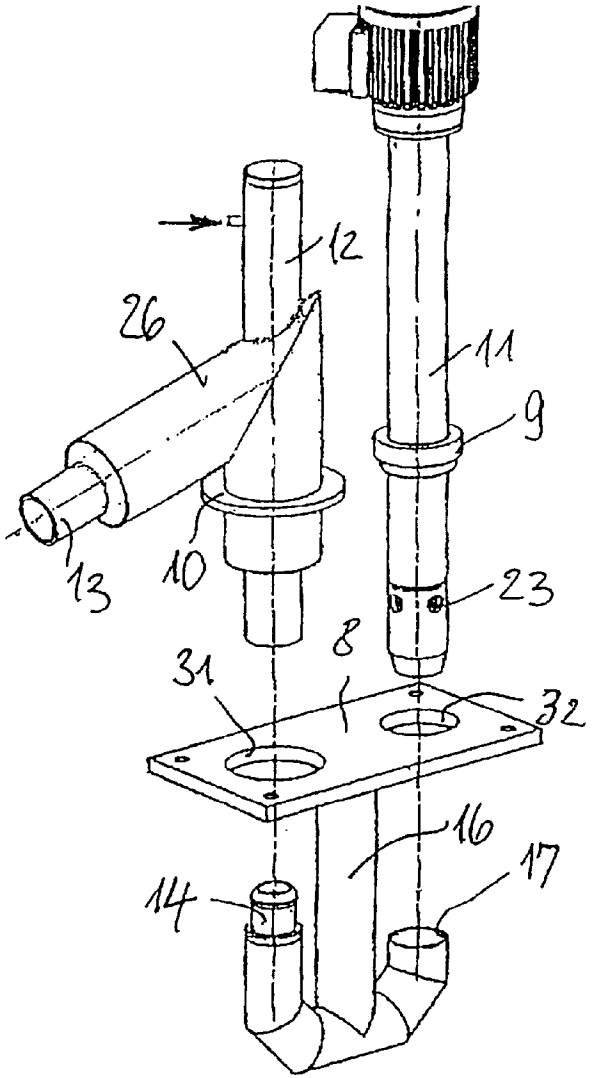
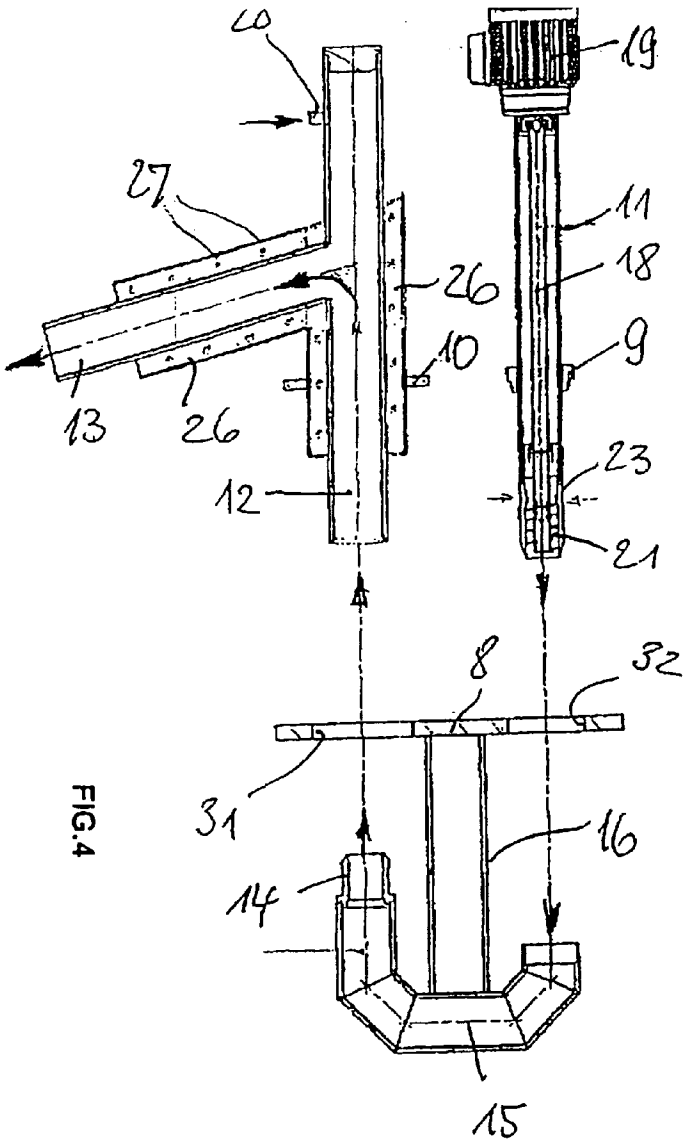
FIG.4

DEVICE FOR SUPPLYING CASTING INSTALLATIONS WITH MOLTEN METAL

The invention relates to a device for supplying casting installations with molten metal, having a melting crucible, a dosing pump dipped into the melt and a discharge pipe, which is communicating with the dosing pump.

An invention of this type is known from DE-OS 2 111 462. This document describes a melting crucible equipped with a dosing container to which a melting crucible is connected. A discharge pipe leads from the dosing container through the wall of the container, so that the pipe is inclined toward the bottom, whose inner edge forms an overflow so that a desired dosing amount of the melts can be output outside when a dosing body having the form of a plunger is dipped inside.

From EP 817 691 B1 is known a device, in which the discharge pipe is also led outside through the wall of the melting crucible so that it is inclined at an angle in the downward direction. This discharge pipe is operated with a dosing pump, which is dipped into the extracting part of the melting crucible.

With a similar device according to prior art, a special crucible is required, which is equipped with a discharge pipe in its side wall. Because this discharge pipe is connected with the melting crucible in a fixed manner, the pivotable crucible must be manufactured with a corresponding type of a die casting machine so that it would match the filling container. The maintenance of such devices is very complicated. This is true also about the actual dosing pump in which the melting level is changed during the dosing operation.

Finally, from DE-PS 1 134 183 is also known a device for supplying casting installations for casting machines according to which the pump is introduced inclined at an angle from the upper part through the cover of the melting crucible into the melt, which itself is also provided at its upper and with a discharge port. Although this pump can be created with a height-adjustable design, the adjustment to the corresponding filling device of pressure casting machines must be carried out also by matching the position of the crucible to the pressure casting machine. A requirement for the necessary cleaning of the pump is that the filling machine must be set in the standstill status.

The purpose of the present invention is to provide a construction of the type described above, which enables simple maintenance and a simple adjustment to the casting machine.

To achieve this task with the device mentioned in the introduction, the discharge pipe is introduced so that it penetrates through the cover of the crucible in the upward direction, and so that it introduced into the cover of the crucible in a pivotable manner. A similar configuration makes it possible to create a sufficiently long construction of the discharge pipe, enabling a simple adjustment to the associated casting device. There is no need to change the position of the melting crucible.

In an advantageous embodiment of the invention, the discharge pipe part can be inserted in the crucible cover unit, which comprises also the dosing pump. Moreover, the dosing pump can be also equipped with a driving motor that is deployed outside of the cover of the crucible, so that the dosing pump penetrates into the melt only with its pump part, that is to say with the suction part and the pressure part.

In an embodiment of the invention, the pressure side of the dosing unit can be connected via a U-shaped connecting pipe with the lower end of the discharge pipe, wherein the connecting pipe attached through a holder to a cover flange, which rests on the cover of the holder.

This cover flange can be provided in an embodiment of the invention with a bushing for the through passage of the discharge pipe and for the dosing pump, so that a crucible is created in the form of one structural unit, wherein this unit can be associated with the melting crucible in a relatively simply manner from the upper part through the cover of the crucible.

The discharge pipe can be also provided in another embodiment with a discharge neck, which is laterally bent at about half the height, so that a supply pipe opening for shielding gas is provided above the discharge neck in the discharge pipe. This embodiment prevents the risk that removed melt will be subjected to oxidation. The discharge pipe can be equipped in the area above the cover of the crucible at least up to the discharge neck with heat insulation and with a heating device. In a particularly advantageous embodiment, the connecting pipe can be equipped with heat-resistant plug connections for the pressure side of the dosing pump and for the discharge pipe. In particular, this embodiment then enables an easy disassembly after the construction of the crucible insert has been completed in order to clean the pump, as well as the discharge pipe and the connecting pipe.

Figure 3:
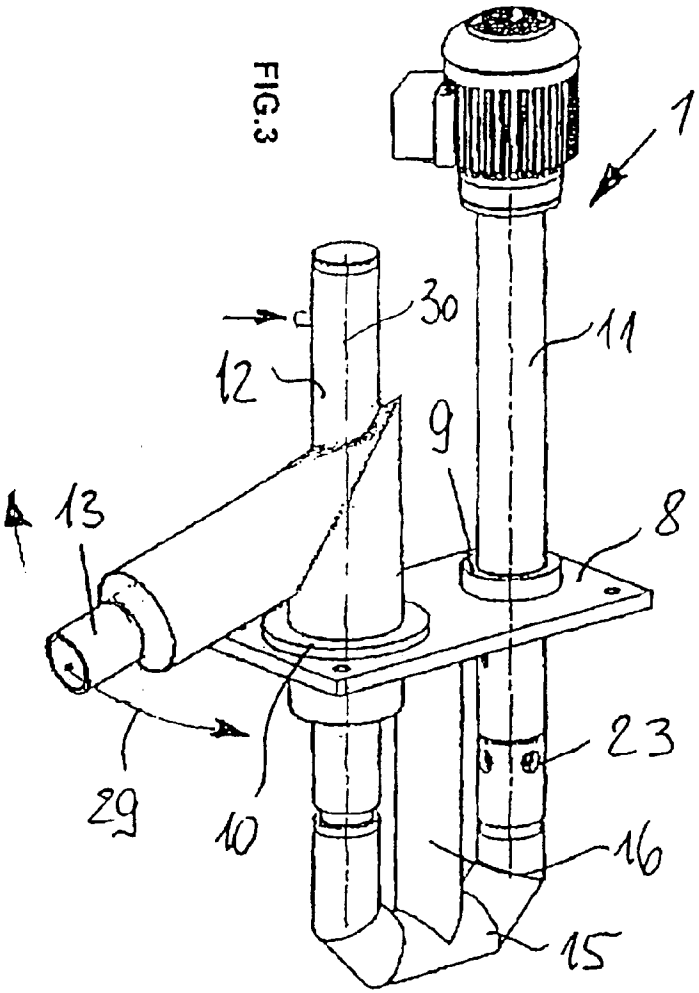
Figure 2:
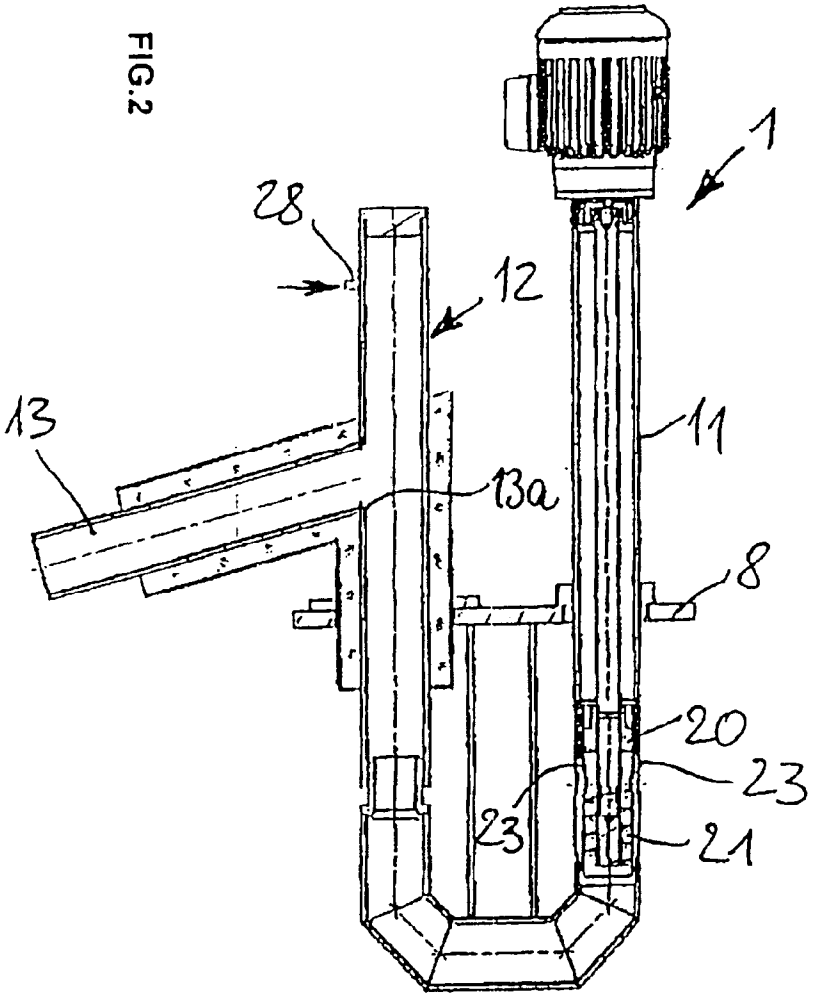

The following is a detailed explanation of the invention illustrated in the figures. The figures show the following:

FIG. 1 a schematic illustration showing a longitudinal, cross-sectional view of a melting crucible equipped with a dosing unit according to the invention, FIG. 2 an enlarged view of a cross-section of the dosing device in FIG. 1, FIG. 3 a perspective representation of the dosing unit according to FIG. 1, FIG. 4 an exploded view of the parts used to create the construction of the dosing unit, and FIG. 5 an exploded view of the part according to FIG. 4, which, however, is not shown as a perspective representation.

FIGS. 1 through 3 show a metering unit 1, also referred to as a dosing unit 1, which is constructed as a crucible insert, and which can be introduced into a metal melt 4 through the upper cover 2 of a melting crucible 3, wherein the level of the melt on the level indicator is maintained by a means that is not shown in the figure. The cover 2 of the crucible is equipped with an opening 7, which is closed by a lid 6 in a known manner, enabling the refilling of the unit with the material to be melted through the opening.

The crucible insert 1 comprises, in particular as one can see from FIG. 2 and FIG. 3, a cover flange 8, also referred to as lid flange 8, which can be placed upon the crucible cover 2, and which is equipped with penetrating openings 31, 32 for a pump pipe 11, which can be introduced vertically to the lid flange 8, or with a discharge pipe 12, which can be also introduced vertically to the lid flange 8. As shown in FIG. 1 and FIG. 2, the discharge pipe 12 is in this case provided at about half of the height with an outlet connection 13, also referred to as a discharge neck 13, which is bent and slightly inclined in the downward direction, and which forms at the upper part of its inner edge 13*a* an overflow edge for the pump pipe 11 from the supplied melt material. The lower end of the discharge pipe 12 is connected by a type of a plug connection 14 to a U-shaped connecting pipe 15, which is in turn connected in a fixed manner by a tubular holder 16 to the lid flange 8. The U-shaped connecting pipe 15 is also equipped on the side of the pump pipe 11 with a plug connection 17, through which it is firmly connected to the lower end of the pump pipe 11.

As one can clearly see from the figure, a driving shaft 18 is mounted in the pump pipe 11 in such a way so that it is rotatable. The driving shaft 18 is provided at its lower end below a bearing 20 with a metering pump, formed by openings 23 and a pump screw 21 or the like. Several openings 23 are arranged in the pipe on the circumference of the pump pipe 11 above the pump screw so that the melt 4 can enter inside the pipe in the direction indicated by arrow 24. The melt is then supplied through the connecting pipe 15 in the direction of the arrow 25 to the overflow edge 13*a* and from there through the discharge neck 13 to a casting apparatus, not shown in the figure. It is clear that with the corresponding application of the drive motor 19, a precise dosage amount of the melt can be output through the discharge neck 13.

The discharge pipe 12 is in this embodiment provided in the area of the lid flange 8 and up to the height of the discharge neck 13 with a jacket 26, which is made of a heat insulating material, and which can be further also associated with a heating system having the form of electrical heating wires 27 or the like. The temperature of the output melt can thus be maintained at a certain level up until just before it is transferred into the casting machine.

As one can further also see from the figures, the discharge pipe 12 is equipped in the area above the discharge neck 13 with a supply connection piece 28 for supplying of a protective gas or a shielding gas, which makes it possible to prevent in this manner the output melt from being subject to the danger of oxidation during its passage through the discharge pipe.

It is essential, as one can see in particular from FIG. 3, that the discharge pipe 12 and the discharge neck 13, which is connected in a fixed manner to this pipe, are arranged so as to be pivotable about the axis 30, which is coincident with the axis of the discharge pipe 12 in the direction indicated by arrow 29. This is achieved when the discharge pipe 12, including the thermal or heat insulation 26, is held in the opening 31 of the lid flange 8 in a pivotable manner, which occurs in each case thanks to the arrangement of the couplings 9 or rings 10.

FIG. 4 and 5 also make it clear that the crucible insert 1, which can be inserted as a complete; structural unit into the crucible 3 and fixed by means of its lid flange 8 to the crucible cover 2, should consist of individual parts which can be relatively easily assembled and then again disassembled. This on the one hand makes it possible to create a simple assembly of a dosing unit, while on the other hand, a simple maintenance and simple cleaning operations are also enabled. A major advantage of this configuration is that it is not necessary to modify the crucible itself, or that a modification is necessary only with respect to its cover. There is no change in the level of the melt during the operation of the pump per se. After the height difference between the level indicator 5 and the overflow edge 13*a* has been overcome in the discharge pipe, the desired dosing operation can take place. The discharge pimp 12 can be removed for maintenance purposes, as shown in FIG. 4 and 5, and it can be easily disassembled and cleaned.

The decisive advantage is that since the discharge neck 13 can be pivoted in the direction of the arrow 29, an adjustment of the position of the crucible itself to the corresponding casting machine is no longer necessary.

In conclusion, it should be also mentioned that according to the selected embodiment, there is no danger of an unintended discharge of the melt because the outlet openings are located above the level of the level indicator 5. The configuration using plug connections and the connection of the pump and of the discharge pump with the connection pipe 15 results in a simple construction of the entire crucible insert 1.

The invention claimed is:

1. A device for charging casting devices with molten metal, comprising:

a crucible;

a metering unit having a metering pump with a pump part projecting into the crucible and a discharge pipe;

wherein the metering unit is designed as a crucible insert having a lid cover flange removably attachable to a cover of the crucible, and wherein the lid cover flange can be placed upon the crucible cover and lifts off the crucible cover while the crucible cover remains in place on the crucible; and wherein the pump part projecting into the crucible contains a pump pipe that extends through an associated passage opening of the lid cover flange and is connected to the discharge pipe, and the discharge pipe is held swivellably in an associated passage opening of the lid cover flange.

2. The device of claim 1, wherein the metering pump is provided with a drive motor arranged outside of the crucible cover.

3. The device of claim 1, wherein a pressure side of the metering pump is connected via a U-shaped connecting pipe with a lower end of the discharge pipe.

4. The device of claim 2, wherein a pressure side of the metering pump is connected via a U-shaped connecting pipe with a lower end of the discharge pipe.

5. The device of claim 3, wherein the connecting pipe is attached via a holder to the lid cover flange which is deployed on the crucible cover.

6. The device of claim 4, wherein the connecting pipe is attached via a holder to the lid cover flange which is deployed on the crucible cover.

7. The device of claim 5, wherein the cover flange is provided with penetrating openings for the pump pipe and the discharge pipe.

8. The device of claim 6, wherein the cover flange is provided with penetrating openings for the pump pipe and the discharge pipe.

9. The device of claim 1, wherein the discharge pipe is provided about half way up with an outlet connection projecting laterally from it.

10. The device of claim 9, wherein a supply opening for protective gas is provided in the discharge pipe above the outlet connection.

11. The device of claim 9, wherein the discharge pipe is provided in an area outside of the crucible cover with a thermal insulation at least up to the outlet connection.

12. The device of claim 9, wherein the discharge pipe is provided in an area outside of the crucible cover with a heating system at least up to the outlet connection.

13. The device of claim 11, wherein the discharge pipe is further provided in the area outside of the crucible cover with a heating system at least up to the outlet connection.

14. A device for charging casting devices with molten metal, comprising:

a crucible;

a metering unit having a metering pump with a pump part projecting into the crucible and a discharge pipe;

wherein the metering unit is designed as a crucible insert having a cover flange attachable to a cover of the crucible, wherein the pump part projecting into the crucible contains a pump pipe that extends through an associated passage opening of the cover flange and is connected to the discharge pipe, and the discharge pipe is held swivellably in an associated passage opening of the cover flange;

wherein a pressure side of the metering pump is connected via a U-shaped connecting pipe with a lower end of the discharge pipe; and wherein the connecting pipe is provided with heat resistant plug connections for the pressure side of the metering pump and for the discharge pipe respectively.

15. A device for charging casting devices with molten metal, comprising:

a crucible;

a metering unit having a metering pump with a pump part projecting into the crucible and a discharge pipe;

wherein the metering unit is designed as a crucible insert having a cover flange attachable to a cover of the crucible, wherein the pump part projecting into the crucible contains a pump pipe that extends through an associated passage opening of the cover flange and is connected to the discharge pipe, and the discharge pipe is held swivellably in an associated passage opening of the cover flange;

wherein the metering pump is provided with a drive motor arranged outside of the crucible cover;

wherein a pressure side of the metering pump is connected via a U-shaped connecting pipe with a lower end of the discharge pipe; and wherein the connecting pipe is provided with heat resistant plug connections for the pressure side of the metering pump and for the discharge pipe respectively.

* * * * *